United States Patent [19]

Broadhurst

[11] 4,334,978

[45] Jun. 15, 1982

[54] DEWAXING AND WAX FILTERABILITY BY REDUCING SCRAPER SPEED IN SCRAPED SURFACE CHILLING UNITS

[75] Inventor: Thomas E. Broadhurst, Sarnia, Canada

[73] Assignee: Exxon Research & Engineering Co., Florham Park, N.J.

[21] Appl. No.: 209,475

[22] Filed: Nov. 24, 1980

Related U.S. Application Data

[63] Continuation-in-part of Ser. No. 86,455, Oct. 19, 1979, abandoned.

[51] Int. Cl.[3] ..... C10G 73/32

[52] U.S. Cl. ..... 208/33; 208/37

[58] Field of Search ..... 208/33, 37, 38

[56] References Cited

U.S. PATENT DOCUMENTS

| | | | |
|---|---|---|---|
| 1,983,301 | 12/1934 | Morgan | 62/114 |
| 2,903,411 | 9/1959 | Shuman | 208/37 |
| 3,773,650 | 11/1973 | Hislop et al. | 208/33 |
| 3,775,288 | 11/1973 | Eagan et al. | 208/33 |

FOREIGN PATENT DOCUMENTS 485847 5/1938 United Kingdom .

*Primary Examiner*—Delbert E. Gantz
*Assistant Examiner*—William Leader
*Attorney, Agent, or Firm*—Joseph J. Allocca

[57] ABSTRACT

In hydrocarbon oil dewaxing processes comprising passing the waxy oil through a staged vertical tower, injecting cold solvent at a plurality of stages along the vertical tower under conditions of high agitation to achieve substantially instantaneous mixing at each point, continuing the chilling, preferably at a rate of from 1° to 8° F. per minute, by means of cold solvent injection until a temperature at least 30° F. above the filtering temperature but less than about 40° to 45° F. above the filtering temperature is reached and completing the cooling of the oil to the separation temperature in rotating element scraped surface chillers, the improvement comprising operating the scraped surface chillers at a chilling temperature range of at least 30° F. while reducing the operating speed of the rotating elements in the scraped surface chiller to a speed of from 5 to 20% preferably 8 to 14% of the original design operation speed. Operation at this reduced speed improves wax separation rates by about 10 to 20% while not adversely effecting the heat transfer performance of the chillers.

24 Claims, No Drawings

DEWAXING AND WAX FILTERABILITY BY REDUCING SCRAPER SPEED IN SCRAPED SURFACE CHILLING UNITS

CROSS-REFERENCE TO RELATED APPLICATIONS

This application is a continuation-in-part of U.S. Ser. No. 86,455, filed Oct. 19, 1979, now abandoned, which is based on PM# SAR-LP 18-79.

BACKGROUND OF THE INVENTION

This invention relates to an improved process for dewaxing hydrocarbon oils, particularly petroleum oils, most particularly lube oils wherein said waxy oil is introduced at a temperature above its cloud point into a first chilling zone divided into a plurality of stages, passing said waxy oil from stage-to-stage of said chilling zone, introducing a cold dewaxing solvent into at least a portion of said stages, whereby a solvent-waxy oil mixture is formed, maintaining a high degree of agitation in at least a portion of the stages containing solvent and waxy oil, thereby effecting substantially instantaneous mixing of said solvent and said waxy oil while cooling said solvent-waxy oil mixture, preferably at a rate of from 1° to 8° F. per minute, as it progresses through said first chilling zone to a temperature greater than the temperature at which the wax is separated from the oil, i.e., the separation temperature, but at least about 30° F. above but less than about 40° to 45° F. above said separation temperature, whereby a substantial portion of the wax is precipitated from said waxy oil under conditions of said high degree of agitation and forming a solvent-oil mixture containing precipitated wax, withdrawing said mixture containing precipitated wax from said first chilling zone, and cooling the same to the separation temperature in a second chilling zone comprising scraped surface chillers, thereby precipitating a further portion of said wax from said waxy oil and separating said wax from the oil-solvent in solid-liquid separation means, the improvement comprising operating the scraped surface chillers of the second chilling zone at a chilling temperature range of at least 30° F. and at a rotating element speed of only from 5 to 20%, preferably 8 to 14% of the original design operating speed. Scraped surface chillers typically operate at rotating element speeds of from 14 to 30 revolutions per minute. This approximately 10 fold decrease in scraper element spped results in obtaining wax filtration rates improved on the order of 10 to preferably 15 to 20%, while heat transfer coefficients are either uneffected or reduced by only about 15%. This loss of heat transfer efficiency is more than compensated by the improved wax filtration rates obtained.

It is known in the prior art to dewax hydrocarbon oilstocks by cooling an oil-solvent solution in scraped surface heat exchangers before separating the crystallized wax from the oil by physical means. In U.S. Pat. No. 3,775,288 it is taught that scraped surface heat exchangers can be used as a secondary cooling zone for the dewaxing of hydrocarbon oils following a primary cooling zone in which oil is cooled by contacting said oil with a cold solvent at a plurality of points along a vertical tower while maintaining a zone of intense agitation in at least a portion of the points of solvent injection, such that substantially instaneous mixing occurs at each point, i.e., within a second or less. This first cooling zone has become known as DILCHILL, a registered service mark of Exxon Research and Engineering Company. In the standard DILCHILL operation, oil is cooled by the injection of a chosen dewaxing solvent along the various stages of the DILCHILL tower with intense agitation from the cloud point to a temperature about 40°–45° F. above the separation temperature of the wax-in-oil typically followed by additional cooling in scraped surface chillers to the separation temperature.

It has been discovered that the above process is improved by reducing the speed of the rotating elements in the scraped surface chiller to a speed of from about 5 to 20%, preferably 8–14% of the original design operation speed of the scraped surface chiller. The chilling temperature range of the scraped surface chiller is at least 30° F. Operation at this reduced speed across the recited temperature range of chilling improves wax filtering rates by about 10 to 20%, preferably 15 to 20%, while not adversely effecting the heat transfer performance of the chillers. This approximately 10 fold decrease in scraper element speed resulting in improved wax separability (as by filtration) is accompanied by no more than a 15% loss of heat transfer efficiency. This loss of heat transfer efficiency is more than made up by the improved wax separation i.e., filtration, etc. rates obtained.

Any hydrocarbon oilstock, petroleum oilstock, distillate fraction or lube oil fraction may be dewaxed by the process of this invention. In general, these stocks will have a boiling range within the broad range of about 500° F. to about 1300° F. The preferred oil stocks are the lubricating oil and specialty oil fractions boiling in the range of 550° F. to 1200° F. These fractions may come from any source such as paraffinic crudes obtained from Aramco, Kuwait, the Pan Handle, North Louisiane, Western Canada, etc. The hydrocarbon oil stock may also be obtained from any of the synthetic crude processes now practiced or envisioned for the future such as coal liquefaction, tar sands extraction, shale oil recovery, etc.

Any low viscosity solvent for oil may be used in the process of this invention, representative of such solvents are the ketones having 3 to 6 carbon atoms such as acetone, methyleethylketone (MEK), and methylisobutylketone (MIBK) and the low molecular weight hydrocarbons such as ethane, propane, butane, propylene and the like, as well as the mixtures of the foregoing ketones and mixtures of the aforesaid ketones with $C_6$ to $C_{10}$ aromatic compounds such as benzene and toluene. In addition, halogenated low molecular weight hydrocarbons such as dichloromethane and dichloroethane and mixtures thereof may be used as solvents. Specific examples of suitable solvent mixtures are methylethylketone and methylisobutylketone; methylethylketone and toluene; acetone and toluene; acetone and propylene; benzene and toluene; dichloromethane and dichloroethane. The preferred solvents are the ketones. A particularly preferred solvent mixture is a mixture of methylethylketone and methylisobutylketone or a mixture of acetone and propylene. Another preferred solvent mixture is methylethylketone and toluene.

General operating conditions of the instant invention are recited and presented in detail in U.S. Pat. Nos. 3,775,288 and 3,773,650, both of which are incorporated by reference. The instant application is an improvement over both of these patents by demonstrating improved dewaxing and wax filterability by reducing the speed of the scraper element in the scraped surface chilling units which follow the DILCHILL process tower.

Scraped surface chillers such as those used in combination with DILCHILL towers described in U.S. Pat. Nos. 3,773,650 and 3,775,288 generally operate at rotating element speeds from 14 to 30 revolutions per minute. This rotation is in response to the need to remove wax from the chiller walls since build-up of wax on the cooling surfaces results in a substantial decrease in the chilling efficiency of the units. The build-up of wax on the chilling surfaces and internals also has the effect of effectively blocking the flow paths of the precipitated wax/oil solvent slurry increasing the pressure drop through the unit. It has now been surprisingly discovered that scraped surface chillers can be run efficiently at approximately a 10 fold decrease in rotating element scraper speed, i.e., at speeds of from 1.5 to 6 RPM, preferably 1.5 to 2.4 RPM and that such a speed reduction does not hamper the heat exchange ability of the chiller nor result in an unacceptable pressure drop across the chiller. The scraped surface chillers are operated so as to have a chilling temperature range of at least 30° F. In fact, and surprisingly, it has been found that the wax coming from such a unit wherein the rotating element is operating at the reduced speed exhibits a surprisingly increase/improvement in separability (i.e., filterability) yielding a wax cake which does not clog the filter clothes or filtering means typically employed in a solid-liquid separating means. The frequency of wax removal from the wall is sufficient to maintain adequate heat transfer rates, but significantly reduces the addition of "wall crystals" to the slurry which are responsible for reducing filtration performance.

EXAMPLE A

The lead and lag scraped surface chillers in a typical DILCHILL process stream had their rotating element speed reduced from 14 RPM to 2.3 RPM in the 6" lead chiller and from 24 PRM to 1.8 RPM in the 8" lag chiller. This reduction in rotating element speed resulted in an increase in laboratory measured wax filter rates by 15% on LP 150N and LP 600N oils. The temperature range of scraped surface chilling in this series of experiments was approximately 40° to 45° F. The dewaxing solvent employed was a mixture of methylethylketone and toluene (70/30). The slurry leaving the DILCHILL crystallizer had a temperature of about 40°-45° F. The slurry leaving the scraped surface chillers had a temperature (wax filtration temperature) of about 0° F.

A base DILCHILL process stream (sequence 1-4) and a test DILCHILL process stream (monitored both before sequence (1A, 2A) and after sequence (3A, 4A) element speed reduction) were compared so as to evaluate the degree of benefit obtained by the speed reduction when handling LP 150N oil stock. Table I summarizes the results of the runs.

TABLE I

BAYTOWN LP 150N TEST RESULTS

| | Sequence | Filter Rate, $m^3/m^2$ day | Liquids Solids | Dilution Ratio w/w | | Filter Rate $m^3/m^2$ day | Liquids Solids | Dilution Ratio w/w | | Filter Rate $m^3/m^2$ day | Liquids Solids | Dilution Ratio w/w | Ratio Outlet/Inlet Filter Rate % |
|---|---|---|---|---|---|---|---|---|---|---|---|---|---|
| DILCHILL | 1 | 9.95 | 4.96 | 2.40 | | | | | | 8.17 | 4.35 | 2.64 | 82.1 |
| TOWER I | 2 | 10.82 | 5.34 | 2.73 | | 11.02 | 4.38 | 2.67 | | 9.01 | 4.43 | 2.62 | 83.3 |
| (Standard) | 3 | 11.22 | 5.13 | 2.65 | | 10.98 | 4.55 | 2.66 | | 8.60 | 4.90 | 2.59 | 76.6 |
| | | | | | 6"SSC* | | | | 8"SSC | | | | |
| | 4 | 11.33 | 5.43 | 2.74 | | 10.97 | 4.54 | 2.71 | | 9.41 | 4.59 | 2.74 | 83.1 |
| | | 10.83 | 5.22 | 2.63 | | 10.99 | 4.49 | 2.68 | | 8.80 | 4.57 | 2.68 | 81.3 |
| DILCHILL | 1A | 10.33 | 5.17 | 2.70 | | | | | | 7.97 | 4.31 | 2.70 | 77.2 |
| TOWER II | 2A | 11.71 | 4.73 | 2.80 | | 12.22 | 4.10 | 2.92 | | 9.18 | 4.20 | 2.66 | 78.4 |
| | | | | | 6"SSC | | | | 8"SSC | | | | |
| (Test) | | 11.69 | 4.51 | 2.80 | | 11.19 | 4.59 | 2.73 | | 9.76 | 4.35 | 2.88 | 83.5 |
| | | 11.24 | 4.80 | 2.77 | | 11.71 | 4.35 | 2.83 | | 8.97 | 4.29 | 2.75 | 79.7 |
| | | | | | ← | Low Speed Drives Installed | | | → | | | | |
| DILCHILL | 3A | 12.29 | 4.90 | 2.88 | | 12.47 | 4.55 | 2.92 | | 10.83 | 4.39 | 2.89 | 88.1 |
| TOWER II | | 12.66 | 4.82 | 2.85 | | | | | | 11.02 | 4.60 | 2.92 | 87.0 |
| | | | | | 6"SSC | | | | 8"SSC | | | | |
| (Test) | 4A | 12.06 | 4.89 | 2.88 | | 12.60 | 3.85 | 2.88 | | 11.14 | 4.15 | 2.87 | 92.5 |
| | | 12.34 | 4.87 | 2.87 | | 12.54 | 4.20 | 2.90 | | 11.00 | 4.38 | 2.89 | 89.2 |

*SSC = scraped surface chiller

The outlet feed filter rate averaged 8.80 $m^3/m^2$ day on the base stream for the entire test period which represents 81.3% of the average filter rate entering the base process stream. The performance of the test stream prior to the speed reduction is similar (sequence 1A, 1B), averaging 8.97 $m^3/m^2$ day or 79.7% of the filter rate entering the test process stream. When the speed of the rotating elements in the scraped surface chillers in the test process stream was reduced (sequence 3A, 4A), the filter rate increased 23% to 11.00 $m^3/m^2$ day; 89.2% of the entering filter rate. Comparing the outlet-inlet filter rate ratio of the test process stream before (79.7%) and after (89.2%), the speed reduction reveals a 12% increase in the throughput as the result of the slow speed scraping.

A similar test was conducted employing LP 600N as the feedstock. This test differed from the previous one, however, in that the before and after data from the test process evaluation stream comes from two different runs. See Table 2. In Table 2 speed reduction is shown only for DILCHILL Tower II (Test Stream) (Sequence A3-C3). The comparison is to a separate and distinct DILCHILL Tower I (Standard stream) (Sequence A1-C1). No direct comparison was run on the test stream with the scraped surface chillers running at normal speed. At a different time, however, DIL- CHILL Tower II (Test Stream) had been run with the scraped surface chillers run at normal speed (Sequence A2-D2).

TABLE 2

LP 600N TEST RESULTS

| | Sequence | Filter Rate $m^3/m^2$ day | Liquids Solids | Dilution Ratio w/w | | Filter Rate $m^3/m^2$ day | Liquids Solids | Dilution Ratio w/w | | Filter Rate $m^3/m^2$ day | Liquids Solids | Dilution Ratio w/w | Ratio Outlet/ Inlet Filter Rate % |
|---|---|---|---|---|---|---|---|---|---|---|---|---|---|
| DILCHILL | A1 | 4.06 | 9.37 | 2.99 | | 3.76 | 7.89 | 2.80 | | 3.34 | 7.79 | 2.96 | 82.3 |
| TOWER I | B1 | 4.00 | 9.50 | 2.77 | 6"SSC* | 3.68 | 8.22 | 2.66 | 8"SSC | 3.44 | 7.83 | 2.76 | 86.0 |
| (STANDARD STREAM) | C1 | 4.22 | 9.96 | 2.63 | | 3.81 | 9.40 | 2.74 | | 3.61 | 8.10 | 2.72 | 85.5 |
| | | 4.09 | 9.61 | 2.80 | | 3.75 | 8.50 | 2.73 | | 3.46 | 7.91 | 7.91 | 84.6 |
| DILCHILL | A2 | 5.25 | 7.22 | 3.18 | | NOT SAMPLED | | | | 3.04 | 7.57 | 3.00 | 57.9 |
| TOWER II | B2 | 5.55 | 7.34 | 2.66 | 6"SSC* | | | | 8"SSC | 3.58 | 7.50 | 2.18 | 64.5 |
| (TEST | C2 | 4.87 | 8.33 | 2.08 | | | | | | 3.20 | 6.76 | 2.77 | 65.7 |
| STREAM) | D2 | 4.77 | 8.11 | 3.20 | | | | | | 3.18 | 6.33 | 2.83 | 66.7 |
| | | 5.11 | 7.75 | 2.78 | | | | | | 3.25 | 7.04 | 2.70 | 63.7 |
| DILCHILL | A3 | 5.09 | 8.60 | 3.16 | | 4.24 | 8.23 | 3.19 | | 3.85 | 7.29 | 3.07 | 75.6 |
| TOWER III | B3 | 4.77 | 8.60 | 3.11 | 6"SSC | 4.54 | 7.42 | 2.83 | 8"SSC | 3.86 | 7.66 | 3.08 | 80.9 |
| (TEST STREAM) | C3 | 5.04 | 8.93 | 2.94 | Reduced Speed | 4.46 | 8.04 | 2.97 | Reduced Speed | 4.06 | 7.54 | 2.91 | 80.6 |
| | | 4.97 | 8.71 | 3.07 | | 4.41 | 7.90 | 3.00 | | 3.92 | 7.50 | 3.02 | 79.0 |

*SSC = scraped surface chiller

Comparing the absolute outlet filter rates before (3.25 $m^3/m_2$ day) (Sequence A2-D2) and after (3.92 $m^3/m^2$ day) (Sequence A3-C3), the speed reduction, based on approximately equal entering filtering rates for the different runs reveals an improvement in the test process stream of about 21%.

EXAMPLE B

The base DILCHILL Process stream and the test process stream (before and after speed reduction) were evaluated to determine the effects of the reduction in the speed of the rotating elements on liquids/solids ratio for LP 150N, and for LP 600N. Based upon approximately equal liquids/solids ratios from the DILCHILL towers, it was determined that the reduction in speed in the scraped surface chiller has little absolute effect on the liquids/solids ratio exiting the process streams. Tables 1 and 2 present this data.

EXAMPLE C

The base DILCHILL process stream and the test process stream, again before and after speed reduction, were compared and evaluated to determine the effect of the speed reduction on heat transfer efficiency. Table 3 summarizes the results of the comparison tests. For given test sequences, as when comparing the before and after values for either LP 150N (Sequences 1A, 2A and 3A, 4A) or LP 600N (Sequences A1, B1, C1 and A3, B3, C3) the slurry flow volumes, flow velocities and chill rates are relatively equivalent.

TABLE 3

HEAT TRANSFER DATA

| | Tube Diameter 6 in Heat Transfer Area 754 $ft^2$ | | | | | | Tube Diameter 8 in Heat Transfer Area 1005 $ft^2$ | | | | |
|---|---|---|---|---|---|---|---|---|---|---|---|
| Sequence | Temp. In °F. | Temp Propane °F. | Q MM $\frac{Btu}{hr}$ | U $\frac{Btu}{hr}$ $ft^2$ °F. | Temp Out °F. | | Temp In °F. | Temp Propane °F. | Q MM $\frac{Btu}{hr}$ | U $\frac{Btu}{hr}$ $ft^2$ °F. | Temp Out °F. |
| | | | 6"SSC* | | | | | | 8"SSC | | |
| 1 | 26.6 | −7.8 | 2.73 | 173.2 | 3.8 | LP 150N | 3.8 | −33.2 | 2.23 | 83.6 | −14.9 |
| 2 | 25.9 | −9.8 | 2.32 | 125.6 | 6.6 | | 6.6 | −32.9 | 2.31 | 79.9 | −12.6 |
| 3 | 24.5 | −8.9 | 2.64 | 165.6 | 3.4 | | 3.4 | −34.4 | 2.35 | 85.2 | −15.3 |
| 4 | 24.0 | −8.4 | 2.44 | 153.4 | 4.5 | | 4.5 | −34.2 | 2.30 | 80.2 | −13.9 |
| | | | 2.53 | 154.5 | | | | | 2.30 | 82.2 | |
| A1 | 33.3 | −6.6 | 2.64 | 138.8 | 8.1 | LP 600N | 8.1 | −22.8 | 1.70 | 78.0 | −8.4 |
| B1 | 32.3 | −6.0 | 2.51 | 133.5 | 9.0 | | 9.0 | −23.7 | 1.81 | 77.3 | −7.7 |
| C1 | 35.5 | −6.5 | 2.29 | 99.6 | 14.8 | | 14.8 | −25.2 | 2.31 | 81.4 | −6.0 |
| | | | 2.58 | 136.2 | | | | | 1.76 | 77.7 | |
| | | | 6"SSC | | | | | | 8"SSC | | |
| 1A | 26.6 | −11.6 | 3.12 | 178.6 | 1.1 | LP 150N | 1.1 | −33.2 | 2.08 | 83.4 | −15.9 |
| 2A | 26.1 | −11.7 | 2.74 | 148.3 | 3.0 | | 3.0 | −32.9 | 2.06 | 78.0 | −14.4 |
| | | | 2.93 | 163.5 | | | | | 2.07 | 80.7 | |
| | Slow Speed Drive Installed | | | | | | Slow Speed Drive Installed | | | | |
| 3A | 26.6 | −12.9 | 2.88 | 145.1 | 3.6 | | 3.6 | −34.4 | 1.99 | 67.3 | −12.2 |
| 4A | 24.4 | −13.0 | 2.71 | 143.3 | 2.8 | | 2.8 | −34.2 | 1.88 | 65.0 | −12.3 |
| | | | 2.80 | 144.2 | | | | | 1.94 | 66.2 | |

TABLE 3-continued

HEAT TRANSFER DATA

| | Tube Diameter 6 in Heat Transfer Area 754 ft² | | | | | | Tube Diameter 8 in Heat Transfer Area 1005 ft² | | | | |
|---|---|---|---|---|---|---|---|---|---|---|---|
| Sequence | Temp. In °F. | Temp Propane °F. | Q MM Btu/hr | U Btu/hr ft² °F. | Temp Out °F. | | Temp In °F. | Temp Propane °F. | Q MM Btu/hr | U Btu/hr ft² °F. | Temp Out °F. |
| A3 | 35.0 | −8.0 | 2.91 | 143.9 | 7.3 | LP 600N | 7.3 | −22.8 | 1.51 | 67.9 | −7.1 |
| B3 | 33.3 | −6.6 | 2.71 | 141.4 | 8.3 | | 8.3 | −23.7 | 1.64 | 68.7 | −6.8 |
| C3 | 36.8 | −6.6 | 2.99 | 142.9 | 9.8 | | 9.8 | −25.2 | 1.85 | 71.6 | −6.8 |
| | | | 2.87 | 142.7 | | | | | 1.67 | 69.4 | |

*SSC = Scraped Surface Chiller

The heat transfer coefficients were calculated for each sequence using average throughput and temperature data for five 1-hour periods during each sequence and averaging the result. For the LP 150N runs, it can be seen that very little change occurred in heat transfer performance of the 6" scraped surface chillers after the speed reduction. An 18% decrease in heat transfer coefficients was recorded for the 8" scraped surface chillers after the speed reduction. For the LP 600N runs, very little difference is seen in the heat transfer coefficients of the 6" chillers while about a 12% reduction in heat transfer coefficient was measured for the 8" chiller. Since a majority of the heat removal occurs in the 6" chiller, the overall debit in heat transfer is about 6 to 7% along the entire process stream.

EXAMPLE D

In another experiment a different (smaller chilling temperature range across the scraped surface chiller was encountered and it was discovered that reducing the speed of the scraped surface chiller rotating elements has little discernable effect on feed filter rate. In the previous examples the chilling temperature range across the scraped surface chiller was approximately 40° F. In the present example the chilling temperature range across the scraped surface chiller was lower, in one instance being about 20° F. and in another instance being about 30° F.

As in the previous examples a waxy oil feed was initially subject to typical DILCHILL dewaxing. The chilled slurry from the DILCHILL crystallizer was then introduced into scraped surface chillers (two 6" scraped surface chillers in each train). Three such trains were employed, X, Y, and Z. Trains X and Y were run at normal conditions, including standard speed scraped surface chiller element rotation rates (14 RPM). Train Z was run at standard and reduced speeds of element rotation (12 and 1.5 RPM's respectively) for comparison. The waxy oil employed in this experiment was LP Heavy Neutral. The dewaxing solvent employed was methylethylketone/methylisobitylketone (~40/60). The results of this experiment are summarized in Table 4.

TABLE 4

| Train | Scraper Speed rpm | Temperature Range of SS (Chilling °F. | Feed Filter Rate Crystallizer Outlet m³/m² day | Feed Filter Rate Chiller Outlet m³/m² day | Change in Filter Rate across SS Chilling % |
|---|---|---|---|---|---|
| X | 14 | 20 | 2.29 | 2.35 | +2.6 |
| Y | 14 | 20 | 2.88 | 2.81 | −2.4 |
| Z | 1.5 | 20 | 3.45 | 3.41 | −1.2 |

TABLE 4-continued

| Train | Scraper Speed rpm | Temperature Range of SS (Chilling °F. | Feed Filter Rate Crystallizer Outlet m³/m² day | Feed Filter Rate Chiller Outlet m³/m² day | Change in Filter Rate across SS Chilling % |
|---|---|---|---|---|---|
| Z | ~12 | 20 | 3.14 | 3.21 | +2.2 |

It is to be noted that the filtration debit across scraped surface chilling is essentially zero even at the normal scraper speeds because of the small temperature range of scraped surface chilling. Operation at the slower scraper speed therefore gives no increase in filter rate. The filtration debits are quite small or non existent because very little wax is added in the scraped surface chillers to the wax that was previously precipitated in the DILCHILL crystallizer. Any benefits due to slow scraper speeds are, therefore, not readily discernable. By way of comparison, in the previous examples the temperature range of chilling across the scraped surface chillers was approximately 40°-45° F. Reference to the data in Example A Table 2 shows that at normal scraped surface chiller speeds (Sequence A1, B1, C1) there was an appreciable filtration debit across the scraped surface chillers.

In another experiment using the same dewaxing train X, Y and Z but employing LP Barosa 56 as the waxy oil the temperature range across the scraped surface chiller was 30° F. The results of this experiment are presented in Table 5 below.

TABLE 5

| DILCHILL Crystallizer Train | Scraper Speed rpm | Temperature Range of SS Chilling °F. | Feed Filter Rate Crystallizer Outlet m³/m² day | Feed Filter Rate Chiller Outlet m³/m² day | Change in Filter Rate % |
|---|---|---|---|---|---|
| X | 14 | 30 | 3.53 | 3.05 | −13.6 |
| Y | 14 | 30 | 3.86 | 3.37 | −12.7 |
| Z | 1.5 | 30 | 3.57 | 3.12 | −12.6 |
| Z | ~12 | 30 | 3.44 | 3.22 | −6.4 |

From this it can be seen that when the chilling temperature range across the scraped surface chiller is sufficiently great so that a filtration debit across the chillers is observed, i.e., additional wax is precipitated in the scraped surface chiller, reduction of the speed of the rotating elements in the chillers will improve the feed filter rate, in this case, decrease the debit as can be seen by comparing the results of the normal speed and low speed runs on train Z. A chilling temperature range therefore of at least 30° F. across the chillers is needed in order to discern the improvement which accompanies a reduction in the speed of the scraped surface chiller rotating elements.

What is claimed is:

1. In a process for dewaxing hydrocarbon oils wherein said oil is introduced at a temperature above its cloud point into a first chilling zone divided into a plurality of stages and cooled by contact with a cold dewaxing solvent injected into said stages, passing the oil from stage-to-stage of said chilling zone, introducing said cold dewaxing solvent into at least a portion of said stages, whereby a solvent-oil mixture is formed, maintaining a high degree of agitation in at least a portion of the stages containing solvent and oil thereby effecting substantially instantaneous mixing of said cold solvent and said oil so as to cool said solvent-oil mixture as it progresses through said first chilling zone to a temperature greater than the temperature at which the wax is separated from the oil, i.e., the wax separation temperature but at least about 30° F. above but less than about 40° to 45° F. above said separation temperature, whereby a substantial portion of the wax is precipitated from said oil under conditions of said high agitation and forming a slurry containing the solvent-oil mix and precipitated wax, withdrawing said slurry containing precipitated wax from said first chilling zone and cooling same to separation temperature in a second chilling zone comprising scraped surface chillers thereby precipitating a further portion of said wax from said oil and separating said wax from the solvent-oil mixture in solid-liquid separation means, the improvement comprising operating the scraped surface chillers of the second chilling zone at a chilling temperature range of at least 30° F. and at a rotating element speed of from 1.5 to 6 RPM.

2. The process of claim 1 wherein the rotating element of the scraped surface chiller rotates at a speed of from 1.5 to 2.4 RPM.

3. The process of claim 1 or 2 wherein the dewaxing solvent is selected from the group consisting of $C_3$ and $C_6$ ketones, low molecular weight hydrocarbons, mixtures of $C_3$ to $C_6$ ketones with aromatic compounds having from 6 to 10 carbon atoms, halogenated low molecular weight hydrocarbons and mixtures thereof.

4. The process of claim 3 wherein the dewaxing solvent is selected from the group consisting of $C_3$ to $C_6$ ketones and mixtures of $C_3$ to $C_6$ ketones with aromatic compounds having from 6 to 10 carbon atoms.

5. The process of claim 3 wherein the dewaxing solvent is selected from the group consisting of methylethylketone, methylisobutylketone and mixtures thereof, methylethylketone and toluene, acetone and toluene, and acetone and propylene.

6. The process of claim 1 or 2 wherein the first chilling zone is a DILCHILL tower.

7. The process of claim 5 wherein the first chilling zone is a DILCHILL tower.

8. The process of claim 6 wherein the wax and oil/-solvent mixture are separated by filtration.

9. In a process for dewaxing petroleum oils wherein said oil is introduced at a temperature above its cloud point into a first chilling zone divided into a plurality of stages and cooled by contact with a cold dewaxing solvent injected into said stages, passing the oil from stage-to-stage of said chilling zone, introducing said cold dewaxing solvent into at least a portion of said stages, whereby a solvent-oil mixture is formed, maintaining a high degree of agitation in at least a portion of the stages containing solvent and oil thereby effecting substantially instantaneous mixing of said cold solvent and said oil so as to cool said solvent-oil mixture as it progresses through said first chilling zone to a temperature greater than the temperature at which the wax is separated from the oil, i.e., the wax separation temperature, but at least about 30° F. above but less than about 40° to 45° F. above said separation temperature, whereby a substantial portion of the wax is precipitated from said oil under conditions of said high agitation and forming a slurry containing the solvent-oil mix and precipitated wax, withdrawing said slurry containing precipitated wax from said first chilling zone and cooling same to separation temperature in a second chilling zone comprising scraped surface chillers thereby precipitating a further portion of said wax from said oil and separating said wax from the solvent-oil mixture in solid-liquid separation means, the improvement comprising operating the scraped surface chillers of the second chilling zone at a chilling temperature range of at least 30° F. and at a rotating element speed of from 1.5 to 6 RPM.

10. The process of claim 9 wherein the rotating element of the scraped surface chiller rotates at a speed of from 1.5 to 2.4 RPM.

11. The process of claim 9 or 10 wherein the dewaxing solvent is selected from the group consisting of $C_3$ to $C_6$ ketones, low molecular weight hydrocarbons, mixtures of $C_3$ to $C_6$ ketones with aromatic compounds having from 6 to 10 carbon atoms, halogenated low molecular weight hydrocarbons and mixtures thereof.

12. The process of claim 11 wherein the dewaxing solvent is selected from the group consisting of $C_3$ to $C_6$ ketones and mixtures of $C_3$ to $C_6$ ketones with aromatic compounds having from 6 to 10 carbon atoms.

13. The process of claim 11 wherein the dewaxing solvent is selected from the group consisting of methylethylketone, methylisobutylketone and mixtures thereof, methylethylketone and toluene, acetone and toluene, and acetone and propylene.

14. The process of claim 9 or 10 wherein the first chilling zone is a DILCHILL tower.

15. The process of claim 13 wherein the first chilling zone is a DILCHILL tower.

16. The process of claim 14 wherein the wax and oil/solvent mixture are separated by filtration.

17. In a process for dewaxing lube oils wherein said oil is introduced at a temperature above its cloud point into a first chilling zone divided into a plurality of stages and cooled by contact with a cold dewaxing solvent injected into said stages, passing the oil from stage-to-stage of said chilling zone, introducing said cold dewaxing solvent into at least a portion of said stages, whereby a solvent-oil mixture is formed, maintaining a high degree of agitation in at least a portion of the stages containing solvent and oil thereby effecting substantially instantaneous mixing of said cold solvent and said oil so as to cool said solvent-oil mixture as it progresses through said first chilling zone to a temperature greater than the temperature at which the wax is separated from the oil, i.e., the wax separation temperature, but at least about 30° F. above but less than about 40° to 45° F. above said separation temperature, whereby a substantial portion of the wax is precipitated from said oil under conditions of said high agitation and forming a slurry containing the solvent-oil mix and precipitated wax, withdrawing said slurry containing precipitated wax from said first chilling zone and cooling same to separation temperature in a second chilling zone comprising scraped surface chillers thereby precipitating a further portion of said wax from said oil and separating said wax from the solvent-oil mixture in solid-liquid separation means, the improvement comprising operating the scraped surface chillers of the second chilling zone at a chilling temperature range of at least 30° F. and at a rotating element speed of from 1.5 to 6 RPM.

18. The process of claim 17 wherein the rotating element of the scraped surface chiller rotates at a speed of from 1.5 to 2.4 RPM.

19. The process of claim 17 or 18 wherein the dewaxing solvent is selected from the group consisting of $C_3$ to $C_6$ ketones, low molecular weight hydrocarbons, mixtures of $C_3$ to $C_6$ ketones with aromatic compounds having from 6 to 10 carbon atoms, halogenated low molecular weight hydrocarbons and mixtures thereof.

20. The process of claim 19 wherein the dewaxing solvent is selected from the group consisting of $C_3$ to $C_6$ ketones and mixtures of $C_3$ to $C_6$ ketones with aromatic compounds having from 6 to 10 carbon atoms.

21. The process of claim 19 wherein the dewaxing solvent is selected from the group consisting of methylethylketone, methylisobutylketone and mixtures thereof, methylethylketone and toluene, acetone and toluene, and acetone and propylene.

22. The process of claim 17 or 18 wherein the first chilling zone is a DILCHILL tower.

23. The process of claim 21 wherein the first chilling zone is a DILCHILL tower.

24. The process of claim 22 wherein the wax and oil-solvent mixture are separated by filtration.

* * * * *